United States Patent [19]

Bay et al.

[11] 4,396,866

[45] Aug. 2, 1983

[54] LAMP FILAMENT DRIVE SCHEME PROVIDING FOR CONTROL OF FILAMENT VOLTAGES BY USE OF LAMP CURRENT IN SOLID STATE BALLASTS

[75] Inventors: David L. Bay, Muncy; William C. Knoll, Turbotville, both of Pa.

[73] Assignee: GTE Products Corporation, Stamford, Conn.

[21] Appl. No.: 220,650

[22] Filed: Dec. 29, 1980

[51] Int. Cl.[3] ..... H05B 41/14; H05B 41/29

[52] U.S. Cl. ..... 315/106; 315/97; 315/220; 315/278; 315/DIG. 7

[58] Field of Search ..... 315/105, 106, 209 R, 315/210, 219, 277, 278, DIG. 7, 220, 97

[56] References Cited

U.S. PATENT DOCUMENTS 4,188,661 2/1980 Bower et al. ..... 315/DIG. 7

FOREIGN PATENT DOCUMENTS 927188 5/1963 United Kingdom ..... 315/DIG. 7

*Primary Examiner*—Eugene La Roche

*Attorney, Agent, or Firm*—John A. Odozynski

[57] ABSTRACT

An output configuration for an electronic ballast system includes means for effecting independent selection of both pre- and post-ignition lamp filament voltages. The primary of a filament voltage control transformer is coupled to lamp filaments so as to induce a voltage in the transformer secondary windings in relation to the lamp filament current. The secondary windings are arranged so that the voltage induced therein adds to the voltage provided to the lamp filaments by filament drive windings on the ballast output transformer.

3 Claims, 1 Drawing Figure

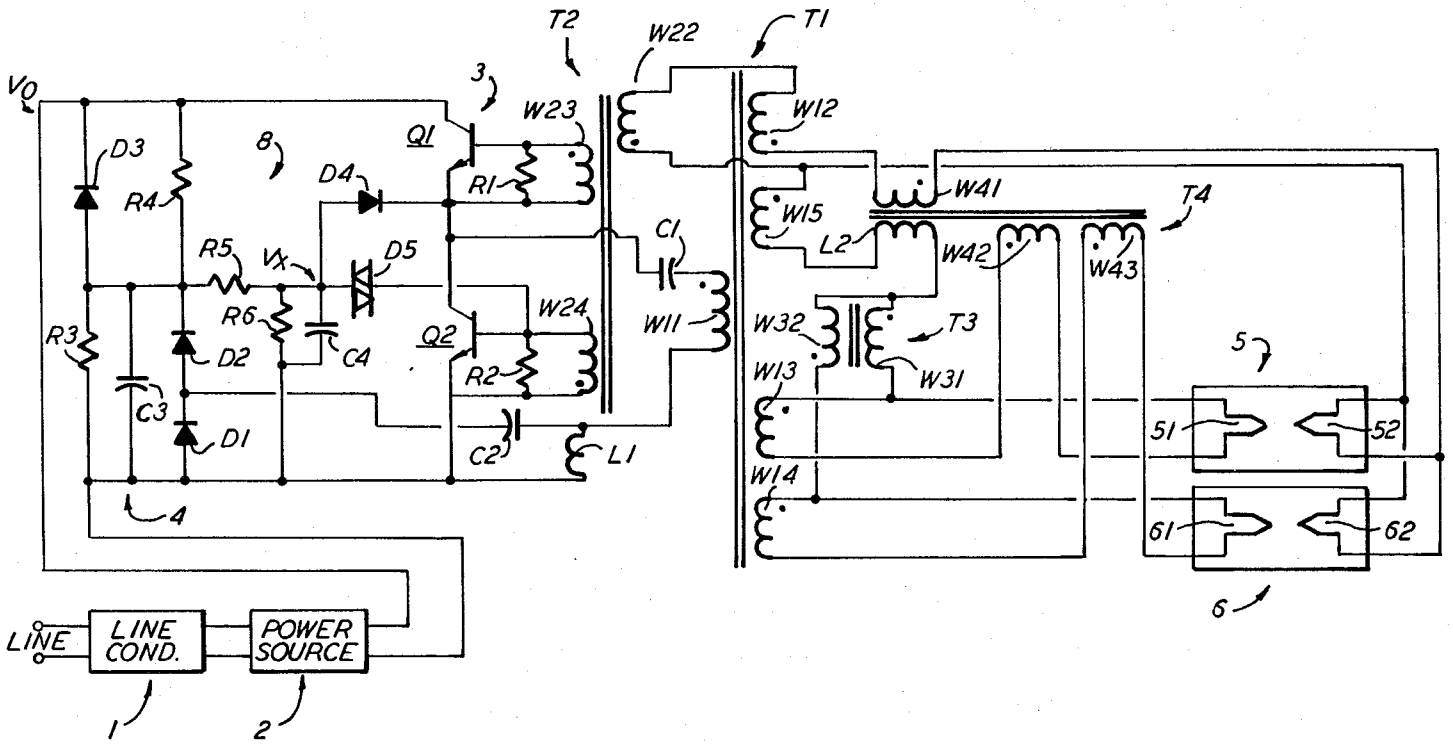
T1
T2
T3
T4
W11
W12
W13
W14
W15
W22
W23
W24
W31
W32
W41
W42
W43
L1
L2
C1
C2
C3
C4
R1
R2
R3
R4
R5
R6
D1
D2
D3
D4
D5
Q1
Q2
Vx
Vo
1
2
3
4
5
6
8
51
52
61
62
POWER SOURCE
LINE COND.
LINE

LAMP FILAMENT DRIVE SCHEME PROVIDING FOR CONTROL OF FILAMENT VOLTAGES BY USE OF LAMP CURRENT IN SOLID STATE BALLASTS

TECHNICAL FIELD

This invention relates to electronic ballast circuitry and more particularly to transformer output configuration that allows independent selection of pre- and post-ignition lamp filament voltages.

BACKGROUND ART

U.S. Pat. No. 4,188,661, "Direct Drive Ballast With Starting Circuit" by Bruce L. Bower and Raymond H. Kohler, dated Feb. 12, 1980 and assigned to the assignee of the present invention and hereby incorporated by reference, describes an electronic ballast circuit for driving a pair of fluorescent lamps. Central to the operation of that circuit is a high frequency (20 to 30 KHz) inverter comprising two transistors connected in series and operating in a push-pull mode. The inverter drives, via an output transformer, the cathode filaments of the lamps. The output transformer comprises a series-resonant primary winding coupled to the inverter output. The secondary of the output transformer includes three filament windings, two for separately supplying current to one filament of each of the lamps. The third filament winding supplies current to the remaining two, parallel-connected filaments. Also included on the secondary of the output transformer is a lamp drive winding connected to a pair of bias windings. The bias windings are oppositely poled and connected in series between the first and second filament windings. These windings are arranged so as to establish a voltage differential across the cathodes of the respective lamps sufficient to effect firing of the lamps.

The ballast circuit further includes an interstage transformer having three primary windings each coupled in a loop that includes at least one lamp filament and a lamp filament winding. The secondary of the interstage transformer includes a pair of oppositely-poled base drive windings coupled to the push-pull inputs of the inverter. Because the primary windings are coupled in a loop that includes the lamp filaments, they include voltages in the base-drive windings proportional to the sum of filament currents. Proper phasing of the secondary windings provides the positive feedback necessary to sustain inverter operation. (A modified feedback arrangement disclosing a single primary winding connected in a loop with the two parallel-connected filaments is disclosed in U.S. Pat. No. 4,127,893, "Tuned Oscillator Ballast Circuit With Transient Compensating Means" by Charles A. Goepel and assigned to the assignee of the present invention. See FIG. 2 of that patent).

U.S. Pat. No. 4,188,661 also discloses circuitry for enhancing the oscillator startup operation. Upon initial energization of the ballast circuit, a capacitor connected in parallel with one of the secondaries of the interstage transformer is slowly charged through a source of slowly developed DC voltage. When the charge across the capacitor reaches a given magnitude, a series connected diac is switched on thereby discharging the capacitor through a relatively low impedance and causing a transient across the secondary of the interstage transformer. This perturbation supplies base drive to at least one of the inverter transistors and assures oscillator startup. A voltage derived from the current in the primary of the output is rectified and applied to the diac in a manner that renders the diac nonconducting during steady state operaton of the ballast circuit.

While it cannot be gainsaid that the circuitry disclosed in the patent discussed above represents a substantial advance in the state of the art of ballast design, with regard to both the conventional electromagnetic and electronic types, the subject invention represents a further substantial advance in that art. In particular, the improved output transformer configuration disclosed herein allows independent selection of both the pre- and post-ignition lamp filament voltages. This feature is highly desirable because the differences in lamp filament pre- and post-ignition voltages impose constraints on the design of the ballast output configuration that render the maintenance of the pre-ignition voltage below filament arc-over voltage difficult to achieve.

DISCLOSURE OF THE INVENTION

The above and other objects and advantages are achieved in one aspect of this invention by an output configuration for an electronic ballast system that effects independent control of the pre- and post-ignition filament voltages. A filament control voltage transformer has a primary winding coupled in series with the lamp current so as to induce a voltage on the transformer secondary windings that is dependent on the lamp current. The secondary windings are coupled in series with the filaments and the filament drive windings so that the voltage induced in the secondary windings adds to the voltage developed across the filaments by the drive windings.

BRIEF DESCRIPTION OF THE DRAWING

The sole drawing is a schematic diagram of an electronic ballast circuit employing the subject invention.

DESCRIPTION OF THE PREFERRED EMBODIMENT

For a better understanding of the present invention, together with the objects, advantages and capabilities thereof, refer to the following disclosure and appended claims in conjunction with the accompanying drawing.

Referring now to the drawing, the electronic ballast circuit derives its primary power from the AC line through a line conditioner 1. The line conditioner may include, inter alia, a transient suppressor, overload switch and line filter. See, e.g. U.S. Pat. No. 4,188,611, supra, at column 2, lines 38–48, column 3, lines 36–52, and as illustrated in the drawings as element 5. The output of the line conditioner is coupled to the input of a voltage supply 2 which provides a nominal output voltage of 300 volts.

The core of the electronic ballast system illustrated in the drawing is the high frequency, push-pull inverter 3 comprising NPN transistors Q1 and Q2. Q1 has a collector connected to the high side of the voltage supply and an emitter connected to the collector of Q2; the emitter of Q2 is in turn connected to the common or ground return of the voltage supply. The base-to-emitter junctions of both Q1 and Q2 are individually coupled by damping resistors, R1 and R2, respectively. The output of inverter 3, that is, the signal at the junction of Q1 emitter and Q2 collector, is coupled through a capacitor C1 to one side of the primary winding, W1, of output transformer T1. The other side of W11 is coupled to the input of what, for present purposes, will be considered a secondary voltage source 4.

Voltage source 4 includes an inductance L1 connected between W11 and the common return. The junction of W11 and L1 is coupled through capacitor C2 to a voltage-doubling peak rectifier that includes diodes D1 and D2, capacitor C3, and resistor R3. D1 has a cathode connected to C2 and an anode connected to the common return. D2 has an anode connected to the cathode of D1 and a cathode connected to one side of C3; the other side of C3 is connected to the common return. R3 is connected in parallel with C3. The output of the secondary voltage source 4 is coupled through a diode D3, in the anode-to-cathode direction, to the high side of the primary voltage source 2.

Operation of voltage supply 4 is contingent on the operation of the inverter circuit in the following manner. When operating, the inverter develops approximately a 20 KHz square wave at the junction of Q1 and Q2. (The frequency of the output signal is largely determined by the resonant frequency of C1 and W11). The current flowing in W11 is coupled to the common return through L1, thereby developing a periodic voltage across L1 in proportion to that current. That voltage is coupled through C1 to rectifying diodes D1 and D2. In standard fashion the charge stored in C3 will represent a voltage substantially equal to the peak-to-peak voltage across L1, less losses attributable to the rectification process. Normally the voltage developed by the secondary source 4 will be less than that developed by the primary source 2 so that D3 will be reverse biased, the two sources isolated from each other, and negligible current will be drawn from the secondary source. However, under low-line or other aberrant conditions, the voltage at the output of source 2 may drop so significantly that D3 will become forward biased and the secondary source will then be available to power the inverter circuitry.

Startup of the oscillator is assured by a startup circuit 5 that includes a charging resistor R4, a voltage divider, resistors R5 and R6, a clamping circuit, diode D4 and capacitor C4 and a semiconductor switch in the form of diac D5.

R4 is coupled from the high side of voltage source 2 to one side of C3 so that, subsequent to the energization of the ballast circuit, C3 begins to charge toward the voltage at the output of that source. (To be precise, it will take some time for output of source 2 to attain its nominal value but this duration can be expected to be de minimis in comparison with the R4C3 time constant). R5 and R6 are series connected across C3, so that the voltage developed at the junction of R5 and R6, ultimately coupled to D5, will track the exponentially-rising voltage across C3. As illustrated in the drawing, D5 has one end coupled to the output of the voltage divider, at the junction of R5 and R6, and the other end coupled to an input of the inverter, at the base of Q2. Neglecting the effect of R3, the voltage, $V_x$, at the output of the voltage divider will increase roughly as $$R6/(R5+R6)\times V_o(1-e-t/R4C3)$$

At some time determined by the values of the components represented in that relationship above, $V_x$ will exceed the breakover voltage of D5. D5 will fire, thereby supplying bias current to the base of Q2 and initiating operation of the inverter, after which the inverter will become self-sustaining. The salient advantage of this startup circuit is that startup of the inverter is inhibited until C3 of the secondary voltage source has become charged. As a result the inverter transistors are spared some deleterious effects attendent the initial current surge required to charge C3.

The startup circuit also includes a clamping circuit comprising D4, with a cathode connected to the inverter output, and an anode connected to the voltage divider output, and C4, connected from there to ground. The clamping action of D4 and C4 prevents the inverter square wave output from randomly firing D5. In effect, the clamping circuit disables the starting circuit during steady state inverter operation so that Q1 and Q2 are not subjected to transients that might result from the random firing of D5.

As illustrated in the drawing the output of the inverter is coupled to T1 and drives a pair of fluorescent lamps, 5 and 6, having filaments 51 and 52 and 61 and 62, respectively. Filament current is supplied by filament drive windings W12, W13 and W14 on the secondary of the output transformer T1. Each of the filament drive windings is arranged to form a circuit loop with at least one filament of a lamp. W13 forms a loop with filament 51, W14 with filament 61, and W12 with parallel-connected filaments 52 and 62. A bias winding, W15, on the secondary of T1 has a first end coupled to filaments 52 and 62, and a second end coupled to filaments 51 and 61. The bias winding establishes the necessary voltage differential across lamps 5 and 6 in order to assure starting of both lamps.

As illustrated in the drawing the bias winding W15 is coupled to filament windings 51 and 61 through an inductance L2 and a transformer T3. One end of L2 is connected to the second end of W15 and the other end is connected to the common terminal of T3. T3, a differential transformer, includes first and second oppositely-poled windings, W31 and W32. W31 and W32 each have one end coupled to the common terminal of T3 and other ends respectively coupled to filaments 51 and 61. T3 comprises approximately 100 turns of 15-#36 Litz wire, bifilar wound on a Ferroxcube type 312 $\frac{1}{4}$ inch "double-E" core.

T3 operates to enhance the firing of cold lamps. Assuming that one of the lamps fires initially, there will be a sudden increase in current through either winding W31 or winding W32, depending on whether lamp 5 or 6 has fired. Assuming lamp 5 has fired the current surge in winding W31, will induce a voltage in winding W32. Because W31 and W32 are oppositely poled, the voltage induced in W32 will add to the voltage developed by drive winding W14, thereby assuring that lamp 6 will fire soon after lamp 5. Of course, the opposite would be true should lamp 6 fire before lamp 5.

L2, coupled between W15 and T3, is included to provide the proper series reactance for lamp ballasting. In practice L2 may comprise approximately 90 turns of 15-#36 Litz wire wound on the primary of a voltage control transformer T4. (The construction, operation and effect of T4 are the subjects of this application and will be detailed below.)

The necessary feedback to sustain inverter oscillation is provided by interstage transformer T2. T2 includes a primary winding W22 and oppositely poled secondary windings W23 and W24. As shown in the drawing W22 is part of a circuit loop that includes filament winding W12 and parallel-connected filaments 52 and 62. Therefore, the current that flows through those filaments must necessarily flow through W22 as well. This signal is fed back to W23, coupled across the base-to-emitter junction of Q1, and W24, coupled across the base-to-emitter junction of Q2, in phase opposition (by virtue of the relative polarities of the windings) so as to effect push-pull operation of the inverter.

Now as to T4. In addition to primary winding L2, T4 includes secondary windings W41, W42 and W43, each comprising approximately 4 turns of #26 wire wound on a Ferroxcube ¼ inch "double-E" core. As illustrated in the drawing, W41 is coupled in series with filament drive winding W12 and the parallel-connected filaments 52 and 62, that is, in a loop that includes W12, filaments 52 and 62, and feedback winding W22 of T3. Similarly W42 is connected in a loop that includes filament drive winding W13 and filament 51, while W43 is connected in a loop that includes filament drive winding W14 and filament 61.

Voltage control transformer T4 operates in conjunction with output transformer T1 to establish the desired pre- and post-ignition RMS voltages across the filament windings in the following manner. As is well known, fluorescent lamp filaments in this type of circuit tend to have a much higher RMS pre-ignition voltage than post-ignition operating voltage. As a result the RMS voltge across the primary, W11, of T1 can be expected to be much greater before the lamps have ignited than afterwards. Given that the flux produced in the core of T1 is proportional to the voltage across W11 multiplied by the number of turns of that winding and that the voltages across the secondary windings W12, W13, W14, and W15 are in turn proportional to the core flux, it follows that the voltages across those filament drive windings will be greater before the lamps have ignited than afterwards. However, in order to maximize the operating lives of fluorescent lamps, it is important to maintain the pre-ignition voltages across the filaments, and therefore the voltages across W12, W13 and W14, below the filament arc-over voltage. The relationship among the desired pre- and post-ignition voltages and the arc-over voltages may, because of the ballast circuit's required output configuration and/or quality factor, leave the circuit designer compromises difficult to resolve. These problems have, however, been overcome by the inclusion of filament voltage control transformer T4.

In essence, the concept is to use the pre- and post-ignition current in the lamp to develop voltages that are combined with the voltages across the filament drive windings so as to create the desired pre- and post-ignition filament voltages. As can be seen from the drawing, W41, W42 and W43 are wound so that the voltages induced in those windings add to the voltage across filament windings W12, W13 and W14, respectively. The voltages induced in W41, W42 and W43 are, of course, related to the current flowing through primary voltage control winding L2. This current is of course equivalent to the total lamp current flowing in lamps 5 and 6. Prior to lamp ignition the lamp current is zero so that substantially no voltage is added to the voltages developed by the filament drive windings. However, after lamp ignition, voltages will be induced in windings W41, W42 and W43 that will be added to the voltages across the filment windings. These voltages will depend, inter alia, on the lamp current and the number of turns of W41, W42 and W43. It is clear that given the concept as presently disclosed, a circuit designer with ordinary skill would be able to construct a voltage control transformer such as T4 that will develop the desired voltages which, when combined with voltages developed by W12, W13 and W14 so as to provide the desired pre- and post-ignitnion filament voltages. In summary, the ballast output configuration disclosed herein allows a ballast designer to have independent control of both the lamp filament voltage both prior and subsequent to lamp ignition. This control allows the designer to circumvent filament arc-over or other deleterious conditions. Furthermore, the scheme is applicable in any single or multiple lamp ballast system that maintains filament voltage subsequent to lamp ignition.

Accordingly, while there has been shown and escribed what are at present considered the preferred embodiments of the invention, it will be obvious to those skilled in the art that various changes and modifications may be made therein without departng from the scope of the invention as defined by the appended claims.

INDUSTRIAL APPLICABILITY

This invention is useful in electronic ballast systems for fluorescent and other types of lamps.

What is claimed is:

1. In an electronic ballast system an output configuration including an output transformer comprising: a primary coupled to a source of periodic signals and a secondary having at least first and second filament drive windings adapted to be coupled to respective first and second lamps and having a bias winding coupled between said first and second filament drive windings for establishing a voltage differential between the lamp filaments, said output configuration further comprising a filament voltage control transformer comprising: a primary winding adapted to be coupled in series with at least a first lamp and at least a first secondary winding adapted to be coupled in a loop with the first filament drive winding and a filament of the first lamp so that the primary winding of the filament voltage control transformer conducts a current comprising the current in the first lamp whereby a voltage is induced in the secondary of the filament voltage control transformer in proportion to the current in the primary winding of the filament voltage control transformer so that the voltage induced in the secondary of the filament voltage control transformer is combined with the voltage developed by the first filament drive winding and wherein the first filament drive winding and the first secondary winding of the filament voltage control transformer are so arranged and constructed that the voltages developed across those windings combine in addition so as to effect the desired pre- and post-ignition filament voltages.

2. An output configuration as defined in claim 1 wherein the secondary of the output transformer has additionally a second and a third filament drive winding adapted to be coupled to a second and a third lamp filament and wherein the filament voltage control transformer further comprises a second and a third secondary winding adapted to be coupled in a loop with the second and the third filament drive windings and a second and a third lamp filament.

3. In an electronic ballast system including an output transformer having a primary winding coupled to a source of lamp filament drive signal and secondary comprising at least first, second, and third filament drive windings for driving at least first, second and third respective lamp filaments, the improvement comprising means for providing independent control of lamp filament voltage, said means comprising a filment voltage control transformer having a primary winding with one end coupled to the lamp drive winding and first, second and third secondary windings, said first secondary winding having one end coupled to the first filament drive winding and a second end for coupling to the first lamp filament whereby the primary winding of the filament voltage control transformer conducts a current comprising the lamp current so that a voltage is induced in the first secondary winding of the filament voltage control transformer in proportion to that current and said voltage is combined with a voltage developed by the first filament drive winding so as to establish the desired pre-and post-ignition filament voltages, and wherein the second and third filament drive windings and the second and third secondary windings of the filament voltage control transformer are so arranged and constructed that the voltages developed by the second and third filament drive windings and the voltages induced in the second and third secondary windings of the filament voltage control transformer combine in addition.

* * * * *